US006179630B1

(12) United States Patent
Chang

(10) Patent No.: US 6,179,630 B1
(45) Date of Patent: Jan. 30, 2001

(54) ELECTRICAL CONNECTOR

(75) Inventor: Yao-Hao Chang, Chung-Ho (TW)

(73) Assignee: Hon Hai Precision Ind. Co., Ltd., Taipei Hsien (TW)

( * ) Notice: Under 35 U.S.C. 154(b), the term of this patent shall be extended for 0 days.

(21) Appl. No.: 09/420,512

(22) Filed: Oct. 18, 1999

(30) Foreign Application Priority Data

Apr. 6, 1999 (TW) ..... 88205237

(51) Int. Cl.[7] ..... H01R 12/20
(52) U.S. Cl. ..... 439/79
(58) Field of Search ..... 439/79, 83, 876

(56) References Cited

U.S. PATENT DOCUMENTS 4,857,017 * 8/1989 Erk ..... 439/695
4,955,819 * 9/1990 Harting et al. ..... 439/79
5,201,662 * 4/1993 Roche ..... 439/79
5,451,158 * 9/1995 Lin et al. ..... 439/79
5,632,650 * 5/1997 Boling et al. ..... 439/79
5,823,799 * 10/1998 Tor et al. ..... 439/79

* cited by examiner

*Primary Examiner*—Gary F. Paumen
(74) *Attorney, Agent, or Firm*—Wei Te Chung

(57) ABSTRACT

An electrical connector mounted to a PCB comprises a housing unit, a contact unit and a pair of boardlocks. The housing unit has a projection with a number of pairs of upper and lower passageways defined therethrough and a pair of slots formed in opposite sides thereof. The contact unit includes a number of pairs of upper and lower contacts respectively received in the upper and lower passageways of the housing unit. Each upper and lower contact in a pair has a bent portion bent in opposite directions from mating portions of the contacts for engaging with contacts in a complementary connector, whereby mounting tails of the contacts are spaced from each other a distance when the mating portions are received in the contact passageways in a manner that they are vertically aligned with each other. The mounting tails are used for mounting the connector to a printed circuit board by Surface Mounting Technology. The boardlocks are received in the slots of the housing unit. Each boardlock has a pair legs and a solder pad on opposite sides thereof.

1 Claim, 4 Drawing Sheets

ELECTRICAL CONNECTOR

BACKGROUND OF THE INVENTION

1. Field of the Invention

The present invention relates to an electrical connector, and particularly to an electrical connector having a high density of contacts retained therein.

2. Description of Prior Art

Generally, a conventional electrical connector having a high density of contacts retained therein is mounted on a printed circuit board (PCB) for electrical connection with the PCB. An arrangement of the contacts may be in several rows, such as upper and lower rows. The upper and lower rows of contacts of some conventional connectors are often offset from each other whereby each contact extends downwardly to form a terminating portion for terminating at the PCB without contacting adjacent contacts. Examples of such conventional electrical connectors are disclosed in Taiwan Patent Application Nos. 78212155, 79204276, 79214090, 80202277, 80209366 and 80213361 and U.S. Pat. Nos. 4,857,017; 4,955,819 and 5,451,158.

However, upper and lower rows of contacts of some connectors are aligned. Thus, the terminating portions of different rows extending downwardly may cause a short circuit between adjacent contacts.

SUMMARY OF THE INVENTION

Accordingly, an object of the present invention is to provide an electrical connector having upper and lower rows of aligned contacts with terminating portions thereof offsetting from each other for properly attaching to a PCB.

In the preferred embodiment of the present invention, an electrical connector mounted to a PCB comprises a housing unit, a contact unit and a pair of boardlocks. The housing unit has a projection with a plurality of upper and lower passageways defined therethrough and a pair of slots formed in opposite lateral sides thereof. The contact unit includes a plurality of pairs of upper and lower contacts respectively received in the upper and lower passageways of the housing unit. Mating portions of each pair of upper and lower contacts are vertically aligned, while tail portions thereof are offset from each other, when the contacts are mounted in a housing of the connector. The boardlocks are received in the slots of the housing unit. Each boardlock has a pair legs and a solder pad on opposite sides thereof.

BRIEF DESCRIPTION OF THE DRAWINGS

Other objects and advantages of the present invention will be understood from the following description of an electrical connector according to a preferred embodiment of the present invention shown in the accompanying drawings, in which.

DETAILED DESCRIPTION OF THE PREFERRED EMBODIMENT

Figure 1:
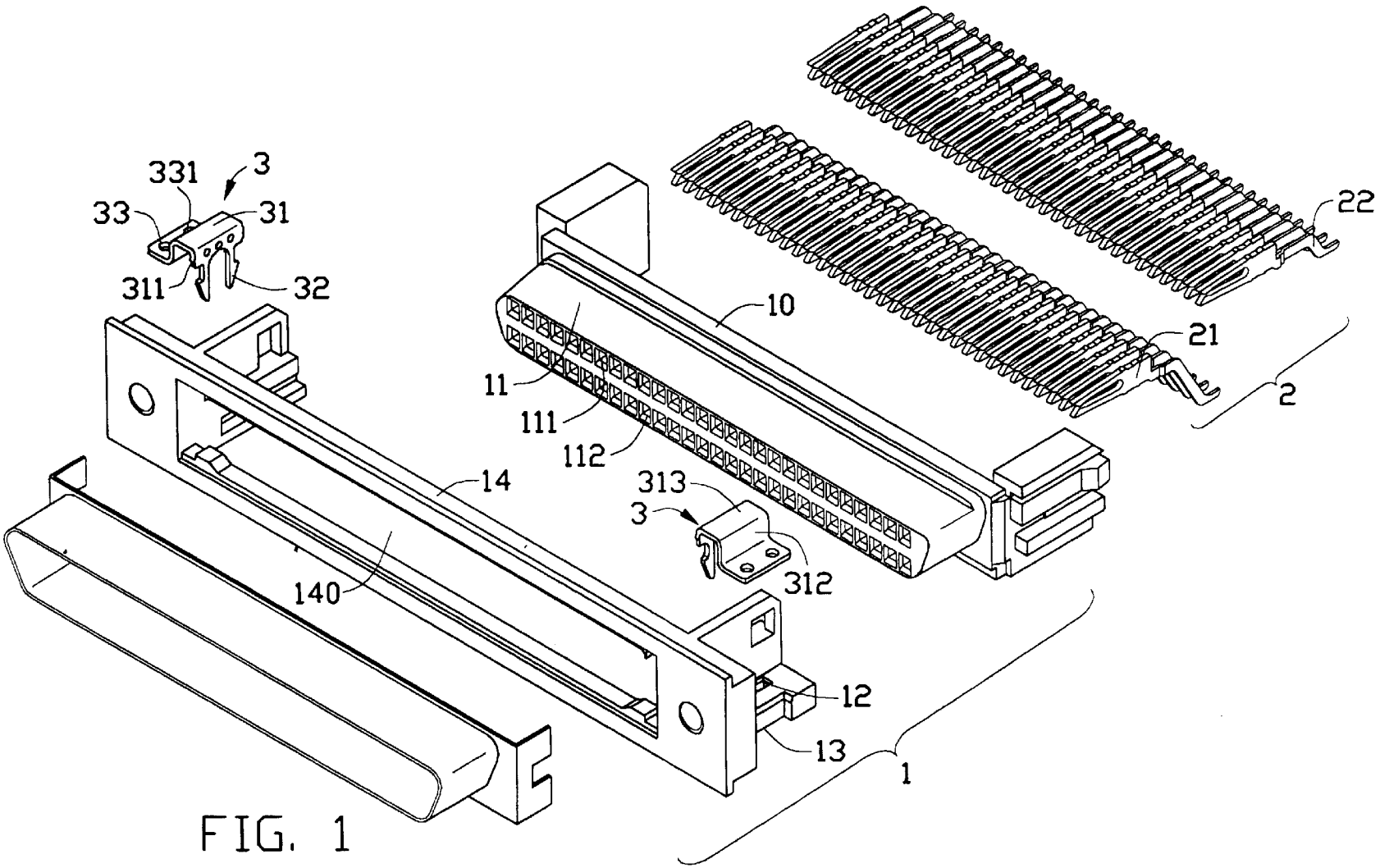
FIG. 1 is an exploded view of an electrical connector embodying the concepts of the present invention.
Figure 2:
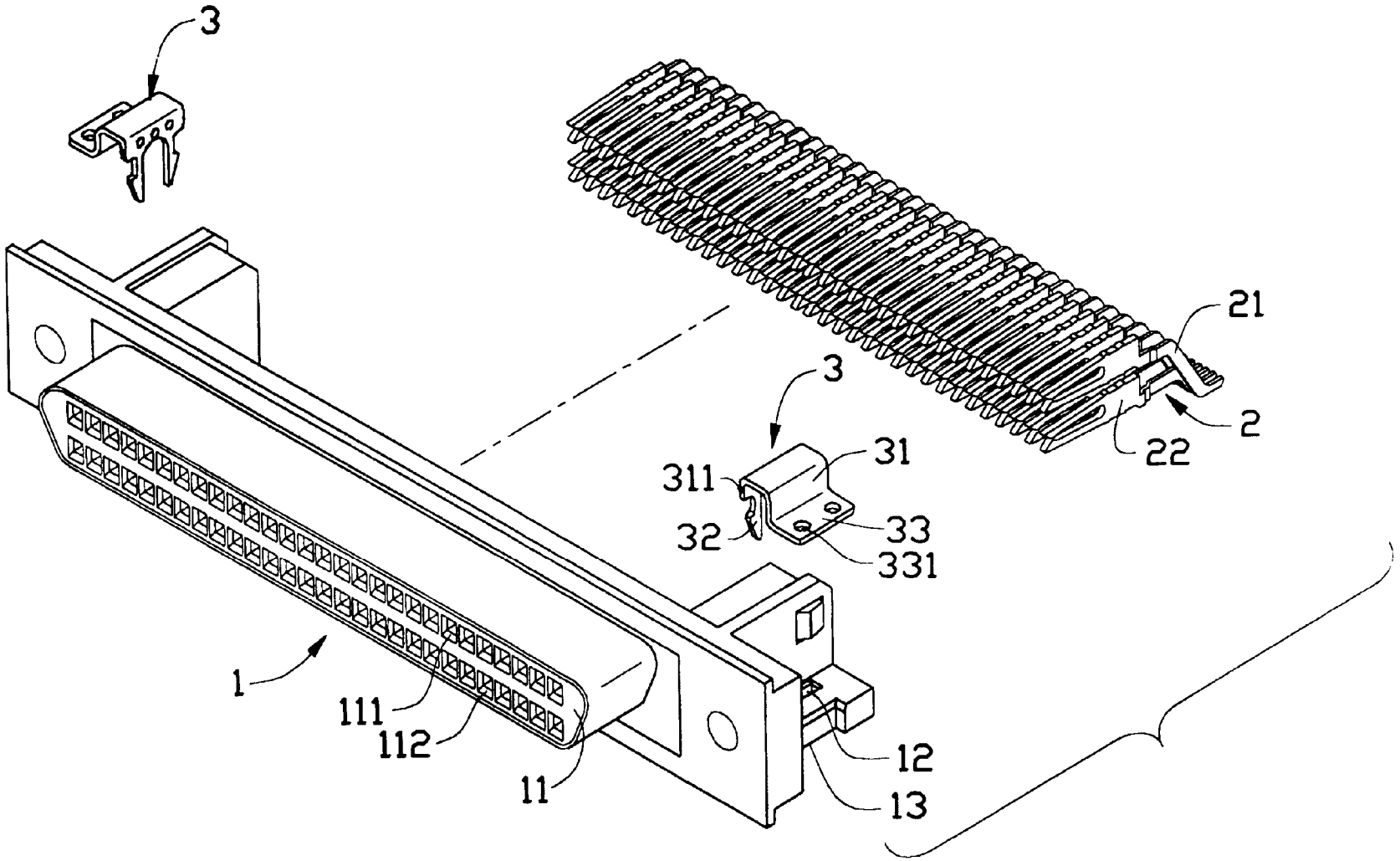
FIG. 2 is a partially assembled view of the electrical connector of FIG. 1.
Figure 3:
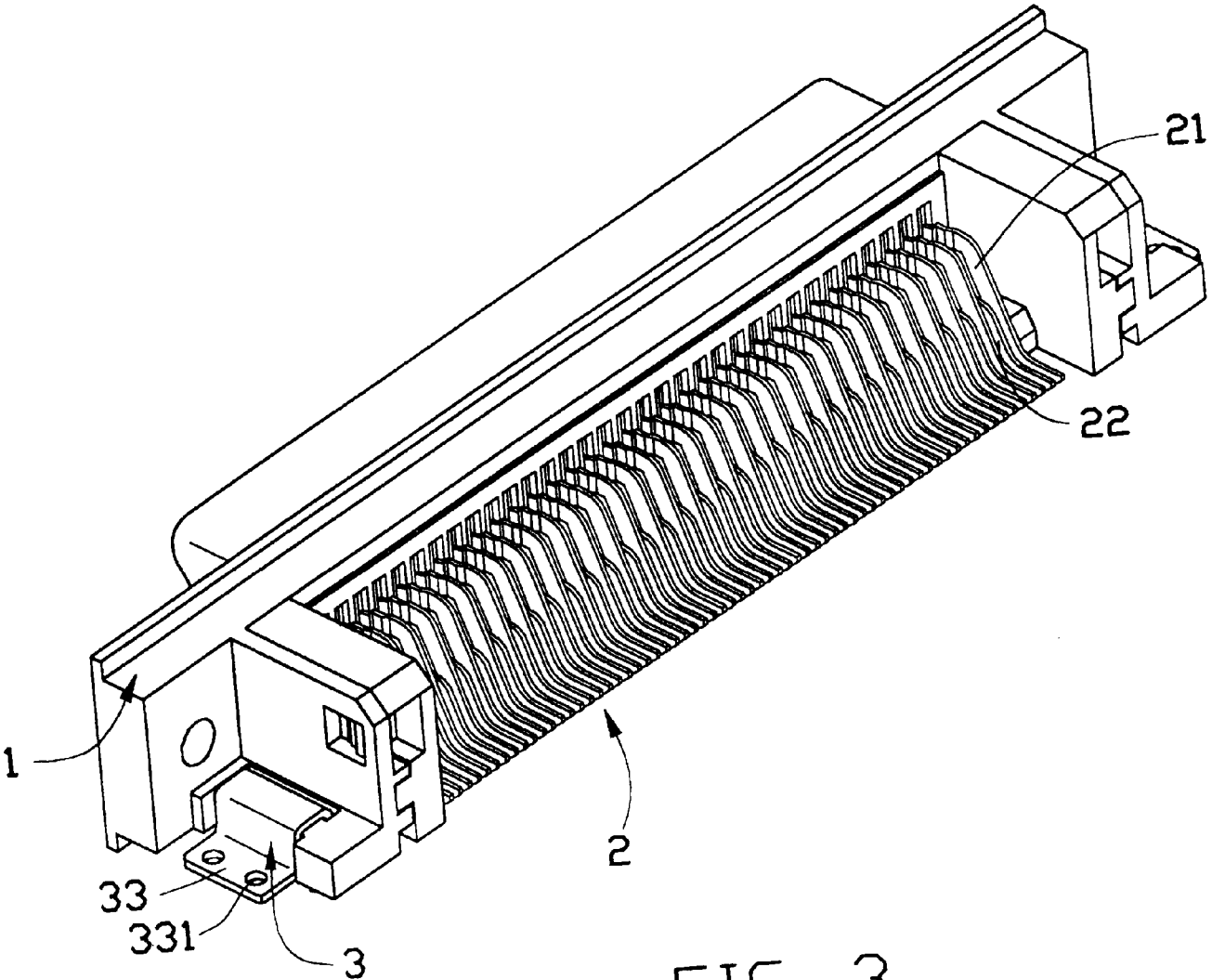
FIG. 3 is an assembled view of the electrical connector of FIG. 1 from a different aspect.

Referring to FIGS. 1 to 3, an electrical connector in accordance with the present invention comprises a housing unit 1, a contact unit 2 received in the housing unit 1 and a pair of boardlocks 3 attached to the housing unit 1. The housing unit 1 comprises a body portion 10 which forms a projection 11 extending from a front surface thereof. Upper and lower rows of passageways 111, 112 aligned with each other are formed through the projection 11. A frame 14 forms a receiving opening 140 for receiving the projection 11 therein. A pair of slots 12 (only one shown) is formed in opposite sides of the frame 14. A pair of cutouts 13 (only one shown) is formed on the opposite lateral sides of the frame 14 proximate and outside the slots 12, respectively.

Each boardlock 3 has a generally inverted U-shaped body 31 with an inner wall 311, an opposite outer wall 312 and a horizontal wall 313 connecting the inner and outer walls 311, 312. The inner wall 311 is used for being interferentially received in the slots 12 of the frame 14. The horizontal and outer walls 313, 312 are used to override on the lateral sides of the frame 1 when the boardlocks 3 are mounted to the frame 14, wherein the outer walls 312 are received in the cutouts, respectively. A pair of legs 32 downwardly extended from a lower edge of the inner wall 311 for having an interference fit with a printed circuit board (not shown) on which the connector 1 is mounted. A solder pad 33 horizontally extends from a lower edge of the outer wall 312 for being soldered to the printed circuit board by Surface Mounting Technology (SMT) to enhance connection between the connector 1 and the circuit board (not shown). A pair of holes 331 is formed in each of the solder pad 33 for facilitating soldering the boardlock 3 to the printed circuit board.

Figure 4:
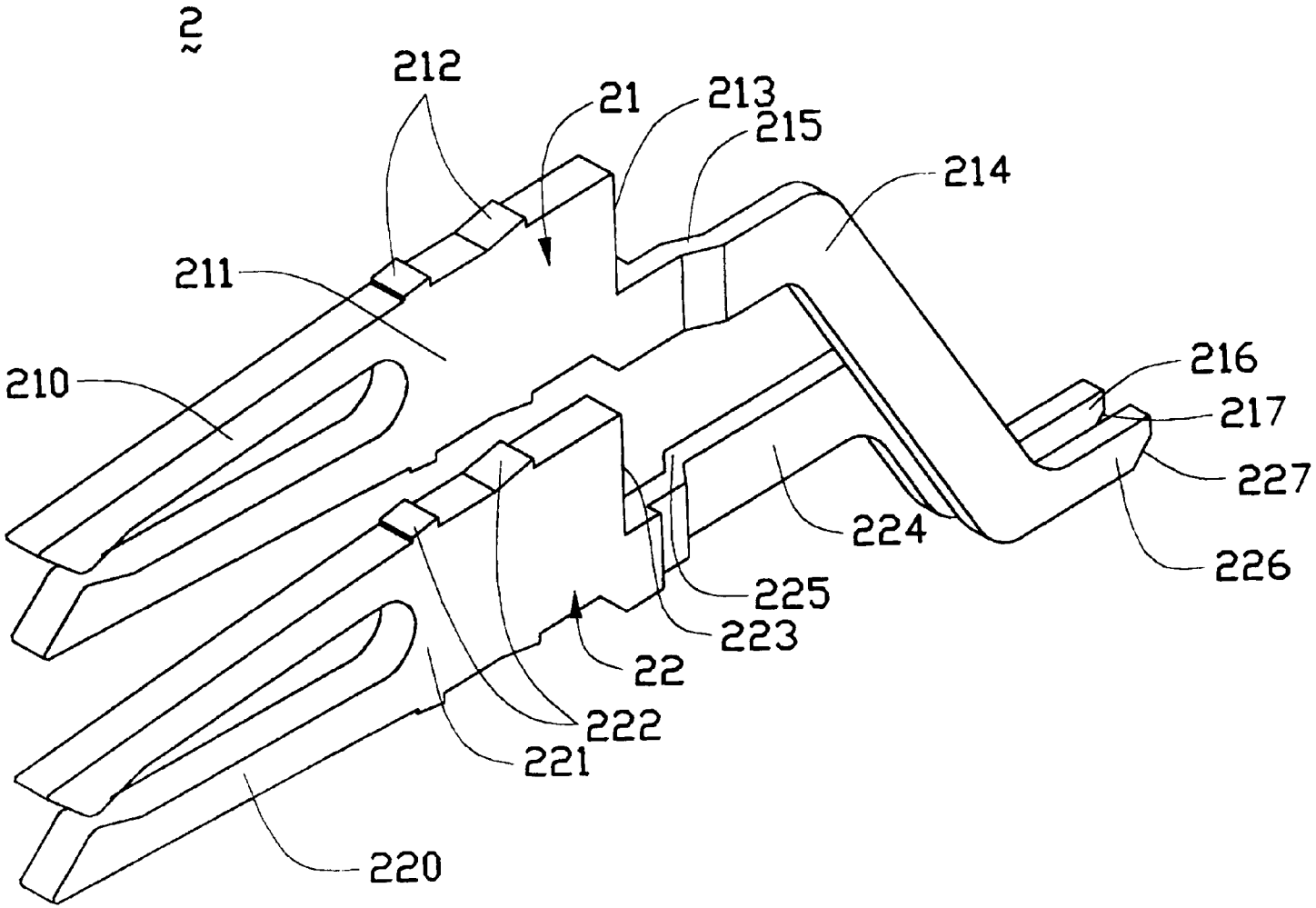
FIG. 4 is an enlarged view of a pair of contacts of FIG. 1.

Further referring to FIG. 4, the contact unit 2 includes a plurality of pairs of upper and lower contacts 21, 22 respectively received in the upper and lower passageways 111, 112 of the housing unit 1. Each upper and lower contact 21, 22 in each pair includes a mating portion 211, 221 and a terminating portion 214, 224 extending from the mating portion 211, 221. Each mating portion 211, 221 has a fork-like front portion 210, 220 for engaging with a mating portion of a contact of a complementary connector (not shown). Each mating portion 211, 221 further forms two pairs of barbs 212, 222 on opposite edges thereof for being interferentially received in the passageways 111, 112, and a shoulder 213, 223 proximate the terminating portion 214, 224 for facilitating insertion of the mating portions 21, 22 into the corresponding passageways 111, 112. The terminating portions 214, 224 form bent portions 215, 225 extending in opposite directions from the mating portions 21, 22. Mounting tails 216, 226 for being mounted on the circuit board are coplanarly extended from bottom edges of the terminating portions 214, 224 in a horizontal orientation, respectively. Therefore, when the mating portions 21, 22 are received in the contact passageways 111, 112 so that the mating portions 21, 22 are vertically aligned with each other, the mounting tails 216, 226 are spaced from each other a distance. Each mounting tail 216, 226 forms a chamfer 217, 227 facing the circuit board for enhancing soldering effects. The thickness of each mating portion 211, 221 is 0.4 mm for withstanding a mating force. The thickness of each terminating portion 214, 224 is 0.25 mm for allowing the mounting tails 216, 226 of the upper and the lower contacts 21, 22 to be properly arranged in a line for surface mounting on the circuit board.

It will be understood that the present invention may be embodied in other specific forms without departing from the spirit of the central characteristics thereof. The present examples and embodiments, therefore, are to be considered in all respects as illustrative and not restrictive, and the invention is not to be limited to the details given herein.

What is claimed is:

1. An electrical connector mounted to a printed circuit board, comprising:

a housing unit comprising a body portion forming a projection with a plurality of upper and lower passageways defined therethrough, and a frame defining a receiving opening for receiving the projection;

a contact unit including a plurality of upper and lower contacts respectively received in the upper and lower passageways of the housing unit, each of the upper contact and the lower contact having a bent portion offset in reversed directions and a mounting tail arranged on a same plane for facilitating a soldering process; and a pair of boardlocks being in opposite sides of the frame for securing the frame to the printed circuit board;

wherein the frame forms a pair of cutouts in opposite ends thereof each for receiving a portion of the respective boardlock therein;

wherein the upper and the lower contacts each have a mating portion and a terminating portion extending from the mating portion, and wherein the bent portion of each contact is formed on the terminating portion;

wherein the mating portion of each contact forms a shoulder proximate the terminating portion for facilitating insertion of the mating portions into the corresponding passageways;

wherein a thickness of the mating portion is larger than a thickness of the terminating portion;

wherein the mounting tail of each contact forms a chamfer at an end thereof for enhancing soldering connection to the printed circuit board thereof.

* * * * *